US006739344B2

(12) United States Patent
Yamashita

(10) Patent No.: US 6,739,344 B2
(45) **Date of Patent: *May 25, 2004**

(54) BIODEGRADABLE CELLULOSE ACETATE STRUCTURE AND TOBACCO FILTER

(75) Inventor: Yoichiro Yamashita, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/941,839

(22) Filed: Aug. 30, 2001

(65) Prior Publication Data

US 2002/0096300 A1 Jul. 25, 2002

Related U.S. Application Data

(63) Continuation of application No. PCT/JP00/01477, filed on Mar. 10, 2000.

(30) Foreign Application Priority Data

Mar. 11, 1999 (JP) ..... 11-065235

(51) Int. Cl.[7] ..... A24D 3/06; C08J 9/00

(52) U.S. Cl. ..... 131/345; 131/332; 131/331; 131/334; 521/50; 428/364; 428/394

(58) Field of Search ..... 131/331, 332, 131/334, 345; 521/50; 428/364, 393, 394

(56) References Cited

U.S. PATENT DOCUMENTS 5,711,322 A * 1/1998 Tsugaya et al. ..... 131/341
5,744,523 A * 4/1998 Barkowsky et al. ..... 523/523
5,913,311 A * 6/1999 Ito et al. ..... 131/342
6,571,802 B1 * 6/2003 Yamashita ..... 131/332

FOREIGN PATENT DOCUMENTS

| | | |
|---|---|---|
| EP | 0597478 | 5/1994 |
| EP | 0632970 | 1/1995 |
| JP | 63105655 | 5/1988 |
| JP | 6-199901 | 7/1994 |
| JP | 7-500385 | 1/1995 |
| JP | 8-70852 | 3/1996 |
| JP | 8-140654 | 6/1996 |
| WO | 9324685 | 2/1993 |
| WO | 93/07771 | 4/1993 |

OTHER PUBLICATIONS

Hawley's Condensed Chemical Dictionary, 13th Edition, John Wiley & Sons, Inc., 1997, p. 199.*

* cited by examiner

*Primary Examiner*—Dionne A. Walls
(74) *Attorney, Agent, or Firm*—Birch, Stewart, Kolasch & Birch, LLP

(57) ABSTRACT

A cellulose acetate structure excellent in its biodegradability. At least a surface region of the structure includes a biodegradable cellulose acetate composition containing a biodegradation promoting agent contained in cellulose acetate. The agent includes at least one compound selected from the group consisting of a salt of an oxygen acid of phosphorus, an ester of an oxygen acid of phosphorus or a salt thereof, carbonic acid and a salt thereof.

10 Claims, 1 Drawing Sheet

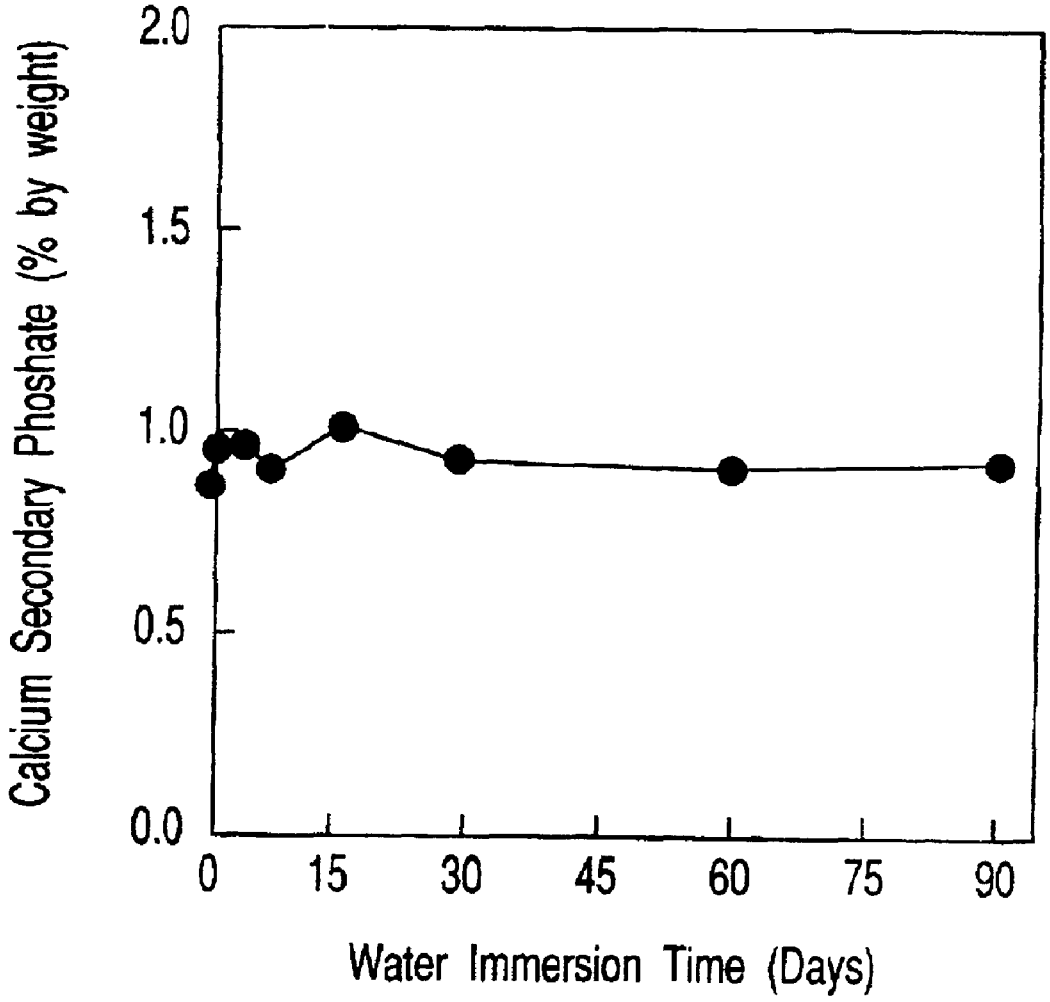
FIGURE

BIODEGRADABLE CELLULOSE ACETATE STRUCTURE AND TOBACCO FILTER

CROSS-REFERENCE TO RELATED APPLICATIONS

This is a Continuation Application of PCT application Ser. No. PCT/JP00/01477, filed Mar. 10, 2000, which was not published under PCT Article 21(2) in English.

This application is based upon and claims the benefit of priority from the prior Japanese Patent Application No. 11-065235, filed Mar. 11, 1999, the entire contents of which are incorporated herein by reference.

BACKGROUND OF THE INVENTION

1. Field of the Invention

The present invention relates to a cellulose acetate structure excellent in its biodegradability and to a tobacco filter.

2. Description of the Related Art

Cellulose acetate is widely used for various structures, e.g., filter raw material, fiber for preparation of a woven fabric for clothing, a film, and molded articles obtained by, for example, injection molding or extrusion molding. A typical example of the cellulose acetate structure is a fiber. Particularly, almost all the tobacco filter is formed of cellulose acetate fiber.

Cellulose acetate fiber is manufactured nowadays as follows. First, flakes of raw material cellulose acetate are dissolved in a solvent such as acetone so as to prepare a spinning stock solution of cellulose acetate. The spinning stock solution thus prepared is spun into a fiber by a dry spinning method in which the spun fiber is discharged into a high temperature atmosphere, thereby obtaining the cellulose acetate fiber. It is also possible to employ a wet spinning method in place of the dry spinning method.

Particularly, in order to facilitate the manufacture of the tobacco filter, the cellulose acetate fiber used as the tobacco filter raw material is set at an appropriate total degree of fineness so as to be finished as a fiber tow. The tobacco filter is manufactured by fibrillating the cellulose acetate fiber tow by a filter plug making apparatus, followed by adding a plasticizer to the fibrillated cellulose acetate fiber and forming the resultant mixture into a rod by using a filter wrapper paper sheet and subsequently cutting the rod into pieces each having a predetermined length.

Cellulose acetate is an acetic acid ester of cellulose and is, essentially, biodegradable. In practice, however, the biodegradability of cellulose acetate is not necessarily high.

For example, the tobacco filter made of cellulose acetate fibers retains its shape even if the tobacco filter is kept buried in the soil for one or two years. A very long time is required for the tobacco filter to be completely biodegraded.

The tobacco filter is incorporated in the tobacco article so as to be circulated to the consumer and, after smoking, is discarded as the tobacco butte. Also, the tobacco filter is discarded directly from the filter manufacturing factory as the residue of manufacture. These discarded tobacco filters are treated as rubbish and in some cases are buried in the ground for disposal. Also, it is possible that the tobacco butte is not collected as rubbish, and is left to stand under the natural environment. These situations apply to not only the tobacco filter but also the general cellulose acetate structure.

Under the circumstances, vigorous research is being conducted on the biodegradation of cellulose acetate. It is reported as a result of such research that the biodegradation rate of cellulose acetate is dependent on the DS (Degree of Substitution: the number of acetyl groups per glucose unit skeleton) of cellulose acetate. To be more specific, if the DS of cellulose acetate is decreased, the biodegradation rate of cellulose acetate is promoted. The biodegradation mechanism of cellulose acetate is considered to be as follows.

In the first step, the acetyl group of cellulose acetate is cut by the exoenzyme released from microorganisms, with the result that the DS of cellulose acetate is decreased. Then, the cellulose acetate with the decreased DS is easily subjected to enzyme decomposition by, for example, cellulase, widely present in the environment and is finally subjected to the microorganism metabolism so as to be decomposed into carbon dioxide and water. The rate-limiting step of the biodegradation rate is considered to reside in the first cutting of the acetyl group. Also, the biodegradation rate of the structure of not only the cellulose acetate but also the overall plastic material is said to be also dependent on the surface area of the structure. To be more specific, if the material is the same, the biodegradation rate is increased with an increase in the contact area per unit weight with the microorganism environment. In other words, to increase the surface area of the plastic structure is to enhance the chance of contact with the decomposing bacteria.

Some methods of promoting the biodegradation rate of cellulose acetate are being proposed on the basis of the ideas described above. For example, it is disclosed in Jpn. Pat. Appln. KOKAI Publication No. 6-199901 that an acid compound having an acid dissociation constant larger than that of acetic acid is added to cellulose acetate. However, if this method is employed in the present manufacturing process of the cellulose acetate fiber, as soon as an acid compound is added to cellulose acetate, the acetyl group of cellulose acetate is subjected to the chemical hydrolytic reaction under the influence of the acid compound. The chemical hydrolytic reaction of the acetyl group of cellulose acetate, which is carried out in the presence of the acid compound, causes DS of the cellulose acetate to be lowered so as to generate acetic acid. In other words, the acetyl group released from cellulose acetate is liberated as acetic acid. It follows that, in this prior art, the cellulose acetate structure is caused to generate a strong acetic acid odor under the influence of the liberated acetic acid. The acetic acid odor is not a desirable factor in the article. In the case of, for example, a tobacco filter, the generation of the acetic acid odor markedly impairs the taste of the tobacco.

It is also disclosed in PCT National Publication No. 7-500385 that a water-soluble compound and an organic compound capable of decomposition by bacteria are added to cellulose acetate. In this method, the added water-soluble compound and the organic compound capable of decomposition by bacteria elution into water under the natural environment and, then, are decomposed by bacteria so as to be released from cellulose acetate. As a result, the cellulose acetate structure is broken so as to increase the surface area of the structure. Since the surface area is increased, the biodegradation rate of cellulose acetate is increased. However, this prior art is intended to increase the chance of contact between cellulose acetate and the cellulose acetate decomposing bacteria, and does not essentially strengthen the functions of cellulose acetate and the cellulose acetate decomposing bacteria. Therefore, this prior art fails to produce the sufficient effect of promoting the biodegradation rate. Also, it is very difficult to mix these compounds in the cellulose acetate fiber in the present manufacturing process of the cellulose acetate fiber.

Further, proposed are several methods for adding microorganisms capable of biodegrading cellulose acetate or various decomposing enzymes of these microorganisms to cellulose acetate fiber. For example, proposed in Jpn. Pat. Appln. KOKAI Publication No. 8-70852 is a method of allowing a microorganism capable of deacetylating cellulose acetate and the deacetylating enzyme produced by the enzyme to be supported by cellulose acetate. These methods are considered to be effective for promoting the biodegradation rate of cellulose acetate. However, each of the additives used in these methods is costly, leading to a considerable increase in the cost of the cellulose acetate structure. Also, in view of mass production of tobacco filters, it is very difficult to use these additives that are not adapted for mass production. Further, it is very difficult to add the additives used in these methods to the cellulose acetate fiber in the present manufacturing process of cellulose acetate fiber. In using these additives, it is unavoidable to change markedly the manufacturing process of the tobacco filter made presently of the cellulose acetate fiber, making it very difficult to put these additives to practical use.

Also proposed are several methods in which a tobacco filter having an excellent biodegradability can be obtained by combining cellulose acetate low in biodegradability with another material high in biodegradability. For example, Jpn. Pat. Appln. KOKAI Publication No. 8-140654 discloses the method of coating the surface of the cellulose fiber such as wood pulp with a cellulose ester such as cellulose acetate. In these methods, however, the biodegradation rate of the entire tobacco filter is determined by the biodegradation rate of the material that can be easily biodegraded and, thus, the biodegradation rate of the cellulose acetate itself is not essentially increased.

Under the circumstances, the present invention is basically intended to provide a means for essentially promoting the mutual function between cellulose acetate and the cellulose acetate decomposing bacteria so as to further improve the biodegradability of cellulose acetate under the natural environment.

To be more specific, the present invention is intended to provide a cellulose acetate structure excellent in its biodegradability while suppressing the deterioration of the quality, particularly, suppressing the generation of the acetic acid odor, and a tobacco filter using the particular cellulose acetate structure.

The present invention is also intended to provide a biodegradable cellulose acetate structure that can be manufactured without markedly changing the existing manufacturing method.

BRIEF SUMMARY OF THE INVENTION

As a result of an extensive research conducted in an attempt to overcome the above-noted problems inherent in the prior art, the present inventors have found that the biodegradability of cellulose acetate can be markedly improved by adding a predetermined compound to cellulose acetate, particularly by adding the predetermined compound to a spinning stock solution and spinning a fiber by using the spinning stock solution when the cellulose acetate is prepared in the form of a fiber.

According to the present invention, there is provided a cellulose acetate structure, at least a surface region of which comprises a biodegradable cellulose acetate composition comprising a biodegradation promoting agent contained in cellulose acetate and comprising at least one compound selected from the group consisting of a salt of an oxygen acid of phosphorus, an ester of an oxygen acid of phosphorus or a salt thereof, carbonic acid and a salt thereof.

It is desirable for the cellulose acetate to have a DS value falling within a range of between 2.0 and 2.6.

The biodegradation promoting agent should desirably have a solubility in water of room temperature of 2 g/dm$^3$ or less. Such a biodegradation promoting agent can be selected from the group consisting of cellulose phosphate, starch phosphate, calcium secondary phosphate, calcium tertiary phosphate, and calcium phosphate hydroxide.

Where the biodegradation promoting agent is in the form of fine particles, it is desirable for the biodegradable cellulose acetate composition to further contain a dispersant for dispersing the fine particles in the composition.

In the present invention, it is desirable for the biodegradable cellulose acetate composition to further contain a photodegradation promoting agent.

The cellulose acetate structure of the present invention may be in the form of fibers or in the form of an unwoven fabric formed of short fibers having a length of 1 to 100 mm.

Further, according to the present invention, there is provided a tobacco filter comprising the cellulose acetate structure of the present invention in the form of fibers or a unwoven fabric.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

The single FIGURE is a graph showing the result of elution into water of calcium secondary phosphate contained in the cellulose acetate.

DETAILED DESCRIPTION OF THE INVENTION

The present invention will now be described in detail, including the preferred embodiments.

The present invention is directed to a cellulose acetate structure formed from a biodegradable cellulose acetate composition in which a predetermined biodegradation promoting agent is contained in the cellulose acetate and also directed to a tobacco filter.

Any type of cellulose acetate can be used in the present invention regardless of the DS value of the cellulose acetate. For example, it is possible to use cellulose diacetate having a DS value of 2.0 to 2.6 and cellulose triacetate having a DS value of 2.6 or more. It is also possible to use cellulose acetate having a DS value of 2.0 or less in which the cellulose acetate exhibits a good biodegradability. Particularly, in the case of manufacturing a tobacco filter, it is desirable to use cellulose diacetate having a DS value falling within a range of between 2.0 and 2.6 in view of the taste of the tobacco when smoked.

In the present invention, at least one compound selected from the group consisting of a salt of oxygen acid of phosphorus, an ester of oxygen acid of phosphorus or a salt thereof, and a carbonic acid or a salt thereof is used as the biodegradation promoting agent that is contained in the cellulose acetate.

The oxygen acid, which is also called an oxo acid, is an acid in which a hydrogen atom or atoms capable of dissociation as a proton is bonded to an oxygen atom or atoms, and includes the condensate thereof if appropriate. To be more specific, the oxygen acid of phosphorus includes, for example, orthophosphoric acid, hereinafter referred to simply as phosphoric acid in some cases, pyrophosphoric acid, metaphosphoric acid, and polyphosphoric acid, as well as phosphorous acid, and hypophosphorous acid. Also, the ester of the oxygen acid of phosphorus is a compound in which at least one hydroxyl group of the oxygen acid is esterified, and includes $PO(OR)(OH)_2$, $PO(OR)_2(OH)$ and $PO(OR)_3$.

The salt used in the present invention also includes hydrogen salt or a complex salt such as a phosphate hydroxide.

Further, when it comes to the compound forming the biodegradation promoting agent, in which a hydrate is present, the hydrate is also included in the biodegradation promoting agent. In this case, the number of bound water molecules is optional.

Needless to say, it is desirable for the biodegradation promoting agent to have a high safety factor and to be supplied in a large amount and at a reasonable cost. Further, where cellulose acetate is formed fibrous for the manufacture of, for example, a tobacco filter, the fibrous cellulose acetate is manufactured in general by the spinning method in which the cellulose acetate solution (spinning stock solution) is discharged through the spinning nozzle. In view of this particular manufacturing method, it is desirable for the biodegradation promoting agent used in the present invention to be soluble in a solvent for dissolving cellulose acetate, e.g., acetone, methylene chloride/methanol mixed solvent. Alternatively, where the biodegradation promoting agent is insoluble in the solvent, it is desirable for the biodegradation promoting agent to consist of a compound that can be finely pulverized to the extent that the physical properties of the fiber are not affected in the spinning process.

In view of safety, the ease of manufacture and the effect of promoting the biodegradability of cellulose acetate, it is desirable for the biodegradation promoting agent used in the present invention to have a solubility in water of room temperature (20° C.) of 2 g/dm$^3$ or less. If the solubility in water is low as noted above, it is possible to suppress the elution of the biodegradation promoting agent from the cellulose acetate structure into water. It is particularly desirable to use cellulose phosphate, starch phosphate, calcium secondary phosphate, calcium tertiary phosphate, calcium phosphate hydroxide or a mixture thereof as such a biodegradation promoting agent.

In the present invention, it is possible to design the biodegradation rate of cellulose acetate by controlling the addition amount of the biodegradation promoting agent.

To be more specific, it is possible to optionally set the addition amount of the biodegradation promoting agent depending on the biodegradation rate aimed at. For example, where it is desired to achieve rapid biodegradation, a large amount of the biodegradation promoting agent is added. However, in view of stability in the manufacture of the cellulose acetate structure, particularly, the stability in the manufacture of the fiber, it is desirable to add the biodegradation promoting agent in an amount of 0.01 to 10% by weight, more desirably in an amount of 0.03 to 3% by weight, based on the amount of cellulose acetate.

It should be noted that, where the biodegradation promoting agent of the present invention is insoluble in the solvent of cellulose acetate in the step of preparing the spinning stock solution, the state of dispersion of the biodegradation promoting agent greatly contributes to the effect of promoting the biodegradation rate. It has been found that, where the comparison is made with the same addition amount, the promoting effect is rendered more prominent in the case where the biodegradation promoting agent, etc. is present in a well dispersed state in the cellulose acetate fiber. It follows that it is more desirable to use a suitable dispersant together with the biodegradation promoting agent. It is possible to use, as such a dispersant, a carboxylic acid polymer.

Also, the particle diameter of the biodegradation promoting agent insoluble in the solvent of cellulose acetate greatly contributes to the promoting effect of the biodegradation rate. It has been found that, if a comparison is made with the same addition amount, the biodegradation promoting effect is rendered prominent with a decrease in the particle diameter. It has also been found that it is desirable for the biodegradation promoting agent insoluble in the solvent of cellulose acetate to have an average particle diameter not larger than 1.0 $\mu$m.

Further, the present inventors have found that, if a photodegradation promoting agent such as titanium oxide, used as a highly light-activated catalyst, is used together with the biodegradation promoting agent of the present invention, the promotion of the photodegradation and the promotion of the biodegradation rate caused by the biodegradation promoting agent of the present invention produce a synergetic effect so as to further promote the degradability of the cellulose acetate structure. In this case, the prominent breakage of the cellulose acetate structure achieved by the biodegradation promoting agent of the present invention allows the photodegradation promoting agent such as titanium oxide used as a highly light-activated catalyst to exhibit more easily the effect of promoting the photolytic degradation. At the same time, the breakage of the cellulose acetate structure caused by the photodegradation promoting agent such as titanium oxide for the highly light-activated catalyst allows the biodegradation promoting agent of the present invention to exhibit more prominently the effect of promoting the biodegradation rate. In this fashion, the erasure of the cellulose acetate structure in the degradation process can be synergetically promoted. It should also be noted that a tobacco filter formed of a cellulose acetate fiber containing both the biodegradation promoting agent of the present invention and the photodegradation promoting agent such as titanium oxide used as a highly light-activated catalyst produces a prominent effect. Specifically, in the initial discarded stage of the tobacco filter in the natural environment, i.e., under the state that the shape of the filter is maintained, the upper portion of the tobacco filter, which is readily exposed to light, is degraded mainly by photodegradation. On the other hand, the lower portion of the tobacco filter, which is readily exposed to microorganisms, is biodegraded. It follows that it is possible to obtain the effect that cannot be expected sufficiently in the case of independently using the biodegradation promoting agent or the photolytic degradation promoting agent, i.e., the effect that the structure of the tobacco filter can be disintegrated more promptly.

It is desirable for titanium oxide acting as the photolytic degradation promoting agent to be an anatase type titanium oxide having desirably a particle diameter not larger than 0.1

μm and to be added in an amount of, desirably 0.01 to 10% by weight, more desirably 0.01 to 3% by weight.

The cellulose acetate composition of the present invention can be formed into various structures by the ordinary method, except that the composition is allowed to contain the biodegradation promoting agent of the present invention and other additives. Therefore, it is unnecessary to change the manufacturing method of the ordinary cellulose acetate structure. For example, it is possible to form the cellulose acetate structure of the present invention by adding the biodegradation promoting agent of the present invention to the solution prepared by dissolving cellulose acetate in, for example, acetone or methylene chloride, followed by forming the cellulose acetate structure of the present invention by the ordinary method. Alternatively, it is also possible to mix, by melting, the biodegradation promoting agent, etc. with the cellulose acetate capable of heat forming and having a plasticizer or the like mixed therein, followed by forming the cellulose acetate structure of the present invention by the ordinary method.

The cellulose acetate fiber used as the tobacco filter can be manufactured, for example, as follows.

First, prepared is a solution (spinning stock solution) containing cellulose acetate and the additives specified in the present invention. It is possible to use methylene chloride or acetone as the solvent. It is also possible to use, as the solvent, a mixture of methylene chloride and methanol. The concentration of cellulose acetate is generally 15 to 35% by weight and should desirably fall within a range of between 18% by weight and 30% by weight. The additives such as the biodegradation promoting agent are contained in the spinning stock solution in the amounts described above. The spinning stock solution can be prepared by mixing a solution prepared by dissolving or dispersing the additives such as the biodegradation promoting agent in a solvent for cellulose acetate with a solution prepared by dissolving cellulose acetate in a solvent for cellulose acetate or by directly adding the additives such as the biodegradation promoting agent to the solution of cellulose acetate.

The cellulose acetate fiber can be obtained by supplying the cellulose acetate spinning stock solution containing the additives such as the biodegradation promoting agent of the present invention to a spinning nozzle apparatus for the spinning by a dry spinning method in which the cellulose acetate stock solution is discharged into a high temperature atmosphere. Alternatively, it is possible to employ the wet spinning method in place of the dry spinning method. Further, for the spinning, it is possible to spin the uniformly dispersed spinning stock solution as it is into fibers as described above. Alternatively, it is also possible to employ a method of composite-spinning into a fiber side-by-side type or a sheath/core type, which is performed by using both the cellulose acetate spinning stock solution containing the additives of the present invention and the cellulose acetate spinning stock solution that does not contain these additives such that at least the cellulose acetate containing the additives of the present invention appears on the fiber surface. Further, in preparing the spinning stock solution, it is also possible use other additives together with the additives specified in the present invention as long as these other additives do not impair the characteristics specified in the present invention. For example, it is possible to use, for example, an emulsifier, a solubilizing agent, and a viscosity controlling agent for improving the uniformity of the spinning stock solution or for controlling the viscosity of the spinning stock solution. As is apparent from the description given above, the cellulose acetate fiber constituting the tobacco filter plug of the present invention contains the additives specified in the present invention in at least the surface region of the cellulose acetate fiber.

The cellulose acetate fiber of the present invention thus obtained can be formed into the tobacco filter by the known method. The manufacturing method and the construction of the tobacco filter are not particularly limited. To be more specific, the tobacco filter can be manufactured, for example, as follows.

Specifically, the cellulose acetate fiber described above is formed into a tow, and the resultant tow is fibrillated by a tobacco filter plug making apparatus. Further, after a plasticizer, e.g., triacetyl glycerin, is added to the fibrillated cellulose acetate fiber, the fiber is formed into a rod, followed by cutting the fibrous rod into a desired length, thereby obtaining the filter plug. Incidentally, for facilitating the preparation of the filter plug, the total degree of fineness of the fiber tow is set appropriately.

In the present invention, it is desirable to form the fibrous rod with the ordinary plug making apparatus by using an unwoven fabric prepared from short fibers, said short fibers being prepared by cutting the cellulose acetate fiber of the present invention into small pieces having a length of 1 to 100 mm. In the tobacco filter prepared by bonding the cellulose acetate fiber tow with a plasticizer, the cellulose acetate fibers are strongly bonded to each other by fusion bonding, with the result that the tobacco filter discarded in the natural environment tends to retain the rod shape stably over a long period of time. On the other hand, if the tobacco filter formed of the unwoven fabric sheet is discarded in the natural environment, the rod shape of the tobacco filter is readily disintegrated by a large amount of water such as rain, sea water, river water or lake water, with the result that the discarded tobacco filter rod is developed into the form of a sheet on the ground. In other words, the contact area of the tobacco filter with the microorganism environment is increased so as to further increase the biodegradation rate of the tobacco filter. It follows that the degradability of the tobacco filter can be further improved together with promotion of the biodegradation rate of the cellulose acetate of the present invention. Incidentally, it is desirable for the unwoven fabric used in the present invention to be excellent in the water dispersion capability. The unwoven fabric excellent in the water dispersion capability can be obtained by the method disclosed in, for example, Jpn. Pat. Appln. KOKAI Publication No. 9-9949. In short, the method disclosed in this Japanese Patent document comprises the steps of forming a fibrillated fiber into a web, allowing the resultant web to be impregnated with a binder solution containing a binder consisting of 40 to 100% by weight of a partially saponified polyvinyl alcohol and 0 to 60% by weight of polyvinyl acetate, and drying the impregnated web.

In the case of using any of the fiber tow or an unwoven fabric, the tobacco filter is finished in general in the shape that the cellulose acetate fiber tow or the unwoven fabric of the cellulose acetate fiber, which is formed into a rod, is wrapped with a filter wrapper paper sheet.

The cellulose acetate fiber of the present invention can be used singly for forming the tobacco filter. Alternatively, it is possible to use another constituent material together with the cellulose acetate fiber of the present invention for manufacturing the tobacco filter of the present invention. The another constituent material noted above includes, for example, a natural or semi-synthetic material such as pulp, linters, cotton, hemp, viscose rayon, copper ammonia rayon, liyocel, wool, or a biodegradable polymer produced by microorganisms such as polyhydroxy alkanoate; an ordinary synthetic material such as a polyolefin such as polypropylene, a polyester such as polyethylene terephthalate, or polyamide; biodegradable synthetic material such as polylactic acid, polycaprolactam, polybutylene succinate, or polyvinyl alcohol; and a photodegradable material. These materials can be used in the form of a fiber or a unwoven fabric. In this case, it is desirable to use a material excellent in biodegradability. It is also possible to use a foamed body of starch as a material excellent in biodegradability, though the foamed body of starch is not a fiber.

It is possible for the cellulose acetate fiber to be in the form of a staple or a filament. It is desirable for the cellulose acetate fiber constituting the tobacco filter of the present invention to be in the form of a fiber tow, and the total degree of fineness of the fiber tow can be made optional. For example, it is desirable to use a bundle-like fiber tow prepared by bundling 3,000 to 500,000 fibers each having a fineness of 0.5 to 15 deniers and having 10 to 50 crimps per 25 mm imparted thereto. Further, the cross sectional shape of each fiber is not particularly limited. For example, it is possible for each fiber to have a circular or rectangular cross sectional shape. However, in view of the filtering performance when used as a tobacco filter, it is desirable for the fiber to have a multi-leaf shaped cross section. Particularly, it is desirable for the fiber to have a Y-shaped cross section in view of the stability in the manufacturing process. It is also possible for the cellulose acetate fiber to be in the form of a fibril. It is desirable to use the cellulose acetate fiber in the form of a fibril together with the other constituent materials described previously or together with the cellulose acetate fiber of the present invention in the form of the ordinary fiber.

Further, in the manufacturing method of the tobacco filter as noted above, it is desirable to use a water-soluble adhesive in place of the plasticizer. In the case of using a plasticizer, the cellulose acetate fibers are strongly bonded to each other by fusion bonding, with the result that the tobacco filter discarded in the natural environment tends to retain the rod shape stably over a long period of time. On the other hand, in the case of using a water-soluble adhesive, the bonding points of the cellulose acetate fibers is readily dissociated by a large amount of water such as rain, sea water, river water or lake water, if the tobacco filter using the water soluble adhesive is discarded in the natural environment. As a result, the rod shape of the tobacco filter is readily disintegrated. It follows that the discarded tobacco filter rod is developed into the form of a sheet on the ground. In other words, the contact area of the tobacco filter with the microorganism environment is increased so as to further increase the biodegradation rate of the tobacco filter. It follows that the degradability of the tobacco filter can be further improved together with promotion of the biodegradation rate of the cellulose acetate of the present invention. It is possible to effectively use the water soluble adhesives disclosed in, for example, Jpn. Pat. Appln. KOKAI Publication No. 8-187073 and Jpn. Pat. Appln. KOKAI Publication No. 9-266783. To be more specific, the water soluble adhesives disclosed in these prior arts include various water soluble polymer materials including, for example, polyvinyl alcohol, polyvinyl pyrrolidone, polyvinyl ether, and vinyl-based water soluble polymer materials including, for example, copolymers between vinyl monomers such as vinyl acetate, vinyl pyrrolidone, vinyl alkyl ether, and styrene, and comonomers capable of copolymerization with the vinyl monomers, said comonomer having a carboxyl group, a sulfonic group or a salt thereof. The comonomers include, for example, α, β-ethylenically unsaturated carboxylic acid and anhydrides thereof such as acrylic acid, methacrylic acid, maleic anhydride, maleic acid, and crotonic acid, and α, β-ethylenically unsaturated sulfonic acid and anhydride thereof such as ethylene sulfonic acid. The water soluble adhesives disclosed in these prior arts further include water soluble acrylic polymer materials, polyalkylene oxide, water soluble polyester and water soluble polyamide.

In the customary manufacturing method for tobacco filters described above, it is desirable to use a filter wrapper paper sheet excellent in its water dispersion capability. Where a tobacco filter is discarded in the natural environment, the presence of the filter wrapper paper sheet arranged to cover the outer circumferential surface of the tobacco filter greatly impairs the contact efficiency between the cellulose acetate fiber and the microorganism environment. In general, a filter wrapper paper sheet is formed of cellulose such as pulp, which is a material excellent in biodegradability. It follows that the filter wrapper paper sheet arranged to surround the outer circumferential surface of the tobacco filter is degraded relatively promptly, i.e., in about 1 to 6 months, in the natural environment. However, depending on the environment in which the tobacco filter is put, a tobacco filter wrapped with a wrapper paper sheet may retain its shape for more than a year. Under the circumstances, in order to bring about the highest contact efficiency between the cellulose acetate fiber and the microorganism environment, it is desirable to use a wrapper paper sheet excellent in the water dispersion capability as the wrapper paper sheet of the tobacco filter. In this case, if the tobacco filter is discarded in the natural environment, the filter wrapper paper sheet surrounding the outer circumferential surface of the tobacco filter can be easily dispersed and removed by a large amount of water such as rain, sea water, river water and lake water. As a result, the cellulose acetate fiber is developed directly on, for example, the ground surface so as to increase the contact area between the cellulose acetate fiber and the microorganism environment so as to promote the biodegradation rate. It follows that the degradation rate of the tobacco filter can be further promoted. In other words, in the case of using a filter wrapper paper sheet excellent in its water dispersion capability, the biodegradation rate of the cellulose acetate of the present invention can be promoted and, at the same, the degradability of the tobacco filter can be further promoted. The filter wrapper paper sheets excellent in the water dispersion capability are exemplified in, for example, Jpn. Pat. Appln. KOKAI Publication No. 9-47271 and Jpn. Pat. Appln. KOKAI Publication No. 9-47272. The filter wind up paper sheets disclosed in these prior arts consist of a base material exhibiting the water dispersion capability including a water soluble paper or a hydrolyzable paper. It is desirable to use a water soluble paper or a hydrolyzable paper prepared by using the fiber used for the paper making (water dispersible fiber) having a water dispersion capability imparted thereto by the known technology of weakening the contact strength or bonding strength among the fibers by weakening the beating. Specifically, it is desirable to use a water soluble paper or a hydrolyzable paper prepared by adding a fibrous carboxymethyl cellulose salt or a fibrous carboxyethyl cellulose salt to the water dispersible fiber noted above in the paper making step. It is also desirable to use a water dispersible base material prepared by adding a fibrous carboxymethyl cellulose or a fibrous carboxyethyl cellulose in the paper making step. The water dispersible fiber used in the present invention includes, for example, wood pulp fibers such as pulp of a coniferous tree, a broad-leaf tree, or a dissolved pulp and/or non-wood plant fibers such as kenaf pulp, hemp pulp, or linters.

The cellulose acetate structure containing the additives specified in the present invention and the cellulose acetate fiber used as the raw material of the tobacco filter are featured as follows.

First of all, the additives specified in the present invention can be added easily to the cellulose acetate structure without changing the conventional manufacturing process of the cellulose acetate structure. For example, when it comes to the structure obtained by the injection molding or the extrusion molding, the cellulose acetate structure of the present invention can be obtained by adding, by means of fusion, the additives specified in the present invention to the cellulose acetate containing, for example, a plasticizer and capable of a heat forming. This is also the case with the cellulose acetate fiber used as the tobacco filter raw material. Where the additives specified in the present invention, which are added to the cellulose acetate fiber, are soluble in the solvent dissolving the cellulose acetate, e.g., acetone or a methylene chloride/methanol mixed solvent, or insoluble in such a solvent, these additives are finely pulverized to the extent that the fiber properties are not disadvantageously affected in the spinning step. As a result, the manufacture of the cellulose acetate fiber is not rendered difficult. In other words, the conventional method can be employed as it is for manufacturing the cellulose acetate fiber of the present invention, except that the additives specified in the present invention are simply added to the spinning stock solution.

It should also be noted that the additives specified in the present invention, which are added to the cellulose acetate structure and the cellulose acetate fiber, exhibit a sufficiently low acidity or a sufficiently low basicity in the manufacturing process of the cellulose acetate structure and the cellulose acetate fiber as well as in the stage of the final product. It follows that no chemical reaction is brought about between the additives and cellulose acetate, with the result that these additives are stably present in the cellulose acetate structure and in the cellulose acetate fiber. Naturally, the cellulose acetate structure and the cellulose acetate fiber manufactured by the method of the present invention are free from deterioration of quality derived from the use of the particular additives and, thus, are fully comparable in quality with the ordinary cellulose acetate structure and the cellulose acetate fiber that do not contain the additives specified in the present invention.

It should be noted that, if the cellulose acetate structure and the cellulose acetate fiber specified in the present invention as well as the tobacco filter formed of the cellulose acetate fiber of the present invention are discarded in the natural environment, these discarded materials exhibit a prominent biodegradability because the additives of the discarded materials produce the effect of promoting the biodegradation rate. What should also be noted is that the additives specified in the present invention exhibit a predetermined solubility in water. Therefore, these additives are not easily released (not eluted into water) from the cellulose acetate structure and from the cellulose acetate fiber under the natural environment and, thus, are retained for a long time in the cellulose acetate structure and the cellulose acetate fiber. In other words, the additives specified in the present invention continue to exhibit the effect of promoting the biodegradability at any time and at any place under the natural environment.

The present invention will now be described more in detail with reference to Examples of the present invention.

EXAMPLE 1

A cellulose acetate solution was prepared by dissolving cellulose acetate flakes (DS=2.5) in acetone to have the cellulose acetate concentration of 28% by weight. Then, calcium tertiary phosphate was added to the solution in an amount of 5% by weight based on the cellulose acetate, followed by stirring the resultant solution. The resultant cellulose acetate solution was casted on a glass plate, followed by drying the cast solution so as to obtain a cellulose acetate film having a thickness of about 100 $\mu$m.

EXAMPLE 2

A cellulose acetate solution was prepared by dissolving cellulose acetate flakes (DS=2.5) in acetone to have the cellulose acetate concentration of 28% by weight. Then, calcium secondary phosphate was added to the solution in an amount of 5% by weight based on the cellulose acetate, followed by stirring the resultant solution. The resultant cellulose acetate solution was casted on a glass plate, followed by drying the cast solution so as to obtain a cellulose acetate film having a thickness of about 100 $\mu$m.

EXAMPLE 3

A cellulose acetate solution was prepared by dissolving cellulose acetate flakes (DS=2.5) in acetone to have the cellulose acetate concentration of 28% by weight. Then, cellulose phosphate was added to the solution in an amount of 5% by weight based on the cellulose acetate, followed by stirring the resultant solution. The resultant cellulose acetate solution was casted on a glass plate, followed by drying the cast solution so as to obtain a cellulose acetate film having a thickness of about 100 $\mu$m.

Comparative Example 1

A cellulose acetate solution was prepared by dissolving cellulose acetate flakes (DS=2.5) in acetone to have the cellulose acetate concentration of 28% by weight. The cellulose acetate solution thus prepared was casted on a glass plate, followed by drying the cast solution so as to obtain a cellulose acetate film having a thickness of about 100 $\mu$m.

Comparative Example 2

A cellulose acetate solution was prepared by dissolving cellulose acetate flakes (DS=2.5) in acetone to have the cellulose acetate concentration of 28% by weight. Then, polyphosphoric acid was added to the solution in an amount of 5% by weight based on the cellulose acetate, followed by stirring the resultant solution. The resultant cellulose acetate solution was casted on a glass plate, followed by drying the cast solution so as to obtain a cellulose acetate film having a thickness of about 100 $\mu$m.

<Measurement of Acetic Acid Concentration and Evalution of Acetic Acid Odor Level>

The acetic acid odor level was evaluated in respect of the cellulose acetate film obtained in each of Examples 1 to 3 and Comparative Examples 1 and 2. Also, for measuring the acetic acid concentration, a circular film piece having a diameter of 5 cm was formed by punching the cellulose acetate film immediately after manufactured. The circular film piece thus prepared was put in an odor bag and left to stand in a constant temperature chamber set at 50° C., and the acetic acid concentration within the odor bag was measured one week later by a gas detection tube method. At the same time, the acetic acid odor level of the film was evaluated by an organoleptic examination method. Table 1 shows the results.

TABLE 1

(Results of acetic acid odor evaluation of various cellulose acetate films)

| Sample | Acetic acid concentration (ppm) | Acetic acid odor level* |
|---|---|---|
| Example 1 | 0.8 | 0 |
| Example 2 | 1.0 | 0 |
| Example 3 | 1.0 | 0 |
| Comparative Example 1 | 0.8 | 0 |
| Comparative Example 2 | 44.0 | 2 |

*Acetic acid odor level:
0: Odor is not detected;
1: Odor is detected;
2: Odor is strongly detected;

As is apparent from Table 1, the cellulose acetate composition containing the biodegradation promoting agent of the present invention is free from generation of an acetic acid odor (quality deterioration) derived from the use of the biodegradation promoting agent. In other words, the biodegradation promoting agent of the present invention does not carry out any chemical reaction with cellulose acetate during the manufacturing process of the cellulose acetate composition and in the stage of the product and, thus, are present stably in the cellulose acetate composition. It follows that the cellulose acetate composition of the present invention exhibits the quality substantially equal to that of the ordinary cellulose acetate composition that does not contain the additives.

<Water Elution Test>

Evaluated was the elution into water of the additive from the cellulose acetate film obtained in each of Examples 1 to 3. For the evaluation, a circular film piece having a diameter of 5 cm, which was punched from each of the cellulose acetate film obtained in each of Examples 1 to 3, was immersed in an ion exchange water for 10 days. Then, the amount of the additive eluted from the cellulose acetate film into the water was measured. The water elution amount of the additive was calculated on the basis of the film weight (dry weight) before immersion in the ion exchange water and the film weight (dry weight) after immersion in the ion exchange water. To be more specific, the ratio of the film weight before the immersion to the film weight after the immersion was defined as the water elution rate. Table 2 shows the results.

TABLE 2

(Results of Water Elution Evaluation of Additive from Cellulose Acetate Film)

| Sample | Water elution rate (%) of additive; |
|---|---|
| Example 1 | 2.0 |
| Example 2 | 16.1 |
| Example 3 | 4.3 |

As is apparent from Table 2, the various additives contained in the cellulose acetate composition of the present invention are not eluted into water. The experimental data support that the additives of the cellulose acetate composition are not easily eluted into water under the natural environment so as to be retained in the cellulose acetate composition for a long time. In other words, the biodegradation promoting agent of the present invention exhibits the effect of promoting the biodegradation rate of the additives at any time and at any place under the natural environment.

<Evaluation of Biodegradability>

Evaluated was the biodegradability of the cellulose acetate film obtained in each of Examples 1 to 3 and Comparative Examples 1 and 2. The evaluation test was conducted by burying a circular film piece having a diameter of 5 cm, which was obtained by punching the cellulose acetate film obtained in each of Examples 1 to 3 and Comparative Examples 1 and 2, in the wet soil and by measuring the weight reduction rate of the buried film piece 45 days later. The weight reduction rate was calculated on the basis of the film weight before the film piece was buried in the soil and the film weight after the film piece was buried in the soil. Table 3 shows the results.

TABLE 3

(Results of Evaluation of Biodegradability of Cellulose Acetate Film)

| Sample | Weight reduction rate (%) | Observation of film outer appearance |
|---|---|---|
| Example 1 | 6.8 | many worm-eaten spots |
| Example 2 | 9.1 | many worm-eaten spots |
| Example 3 | 16.2 | brittle and reduction of piece size, many worm-eaten spots |
| Comparative Example 1 | 0.8 | no appreciable change |

Table 3 supports that the biodegradation rate of the cellulose acetate was promoted in any of the Examples of the present invention.

EXAMPLE 4

Cellulose acetate (DS: 2.5) was dissolved in acetone in a concentration of 28% by weight, followed by adding titanium oxide particles having a weight average particle diameter of 0.2 $\mu$m to the resultant solution in an amount of 0.5% by weight based on the amount of cellulose acetate, while stirring the system, so as to obtain a uniform dispersion. Then, calcium secondary phosphate having a weight average particle diameter of 0.46 $\mu$m was added to the resultant dispersion in an amount of 1% by weight based on the amount of cellulose acetate while stirring the dispersion until the added calcium secondary phosphate was dispersed uniformly so as to obtain a spinning stock solution.

The spinning stock solution was filtered and, then, spun by a dry spinning method using a known filter bundle spinning apparatus so as to obtain cellulose acetate filaments. A predetermined amount of the cellulose acetate filaments was bundled and crimped so as to obtain a cellulose acetate fiber tow, each fiber having a Y-shaped cross section and a degree of fineness of 3 deniers. The total degree of fineness of the cellulose acetate fiber tow was 36,000 deniers.

A tobacco filter was manufactured as follows by using the cellulose acetate fiber tow thus obtained. Specifically, the cellulose acetate fiber tow was fibrillated by using a known tobacco filter plug making apparatus, followed by adding 6.0% by weight of a plasticizer (triacetyl glycerin) to the cellulose acetate fiber tow and subsequently wrapping the fibrillated cellulose acetate tow with a filter wrapper paper so as to prepare a rod. Finally, the rod thus prepared was cut into small pieces each having a predetermined length, thereby obtaining the filter plug.

The cellulose acetate fiber tow and the tobacco filter thus obtained were observed. It has been found that the moldability of the cellulose acetate fiber tow and the tobacco filter was not affected by the addition of calcium secondary phosphate. Also, the cellulose acetate fibers were subjected to ashing so as to calculate the calcium secondary phosphate content of the cellulose acetate fiber by the quantitative analysis (weighing) and the qualitative analysis (element analysis) of the ash. Table 4 shows the results.

TABLE 4

(Additive content of cellulose acetate fiber)

| Charged amount in spinning stock solution | Content in fiber |
|---|---|
| 1.0% by weight based on cellulose acetate | 0.86% by weight based on cellulose acetate |

Table 4 clearly supports that it is possible to allow the cellulose acetate fiber to contain a solid additive like the calcium secondary phosphate particles used in Example 4.

EXAMPLE 5

Cellulose acetate (DS: 2.5) was dissolved in acetone in a concentration of 28% by weight, followed by adding titanium oxide particles having a weight average particle diameter of 0.2 $\mu$m to the resultant solution in an amount of 0.5% by weight based on the amount of cellulose acetate while stirring the system so as to obtain a uniform dispersion. Then, calcium secondary phosphate having a weight average particle diameter of 1.20 $\mu$m was added to the resultant dispersion in an amount of 1% by weight based on the amount of cellulose acetate while stirring the dispersion until the added calcium secondary phosphate was dispersed uniformly so as to obtain a spinning stock solution. A cellulose acetate fiber tow and a tobacco filter were prepared as in Example 4 by using the spinning stock solution thus obtained.

The cellulose acetate fiber tow and the tobacco filter thus obtained were observed. It has been found that the moldability of the cellulose acetate fiber tow and the tobacco filter was not affected by the addition of calcium secondary phosphate.

Comparative Example 3

Cellulose acetate (DS: 2.5) was dissolved in acetone in a concentration of 28% by weight, followed by adding titanium oxide particles having a weight average particle diameter of 0.2 $\mu$m to the resultant solution in an amount of 0.5% by weight based on the amount of cellulose acetate while stirring the system so as to obtain a uniform dispersion, thereby obtaining a spinning stock solution. A cellulose acetate fiber tow and a tobacco filter were prepared as in Example 4 by using the spinning stock solution thus obtained.

Comparative Example 4

Cellulose acetate (DS: 2.5) was dissolved in acetone in a concentration of 28% by weight, followed by adding titanium oxide particles having a weight average particle diameter of 0.2 $\mu$m to the resultant solution in an amount of 0.5% by weight based on the amount of cellulose acetate, while stirring the system, so as to obtain a uniform dispersion. Then, polyphosphoric acid was added to the resultant dispersion in an amount of 1% by weight based on the amount of cellulose acetate while stirring the dispersion until the added calcium secondary phosphate was dispersed uniformly so as to obtain a spinning stock solution. A cellulose acetate fiber tow and a tobacco filter were prepared as in Example 4 by using the spinning stock solution thus obtained.

<Acetic Acid Concentration and Evaluation of Acetic Acid Odor Level>

The acetic acid odor level was evaluated in respect of the tobacco filter obtained in each of Examples 4 and 5 and Comparative Examples 3 and 4. Also, for measuring the acetic acid concentration, the tobacco filter, immediately after being manufactured, which had a length of 25 mm, was put in an odor bag and left to stand in a constant temperature chamber set at 50° C., and the acetic acid concentration within the odor bag was measured two weeks later by a gas detection tube method. At the same time, the acetic acid odor level of the tobacco filter was evaluated by an organoleptic examination method. Table 5 shows the results.

TABLE 5

(Results of acetic acid odor evaluation of tobacco filter)

| Sample | Acetic acid concentration (pmm) | Acetic acid odor level* |
|---|---|---|
| Example 4 | 0.5 | 0 |
| Example 5 | 0.3 | 0 |
| Comparative Example 3 | 0.5 | 0 |
| Comparative Example 4 | 11.0 | 1–2 |

*Acetic acid odor level:
0: Odor is not detected;
1: Odor is detected;
2: Odor is strongly detected;

As is apparent from Table 5, the cellulose acetate fiber of the present invention is free from generation of an acetic acid odor (quality deterioration) derived from the use of the additive (biodegradation promoting agent). In other words, the additive of the present invention does not chemically react with cellulose acetate during the manufacturing process of the cellulose acetate fiber or in the product stage and, thus, is stable. It follows that the cellulose acetate fiber of the present invention exhibits qualities substantially equal to that of the ordinary cellulose acetate fiber that does not contain the additive.

<Water Evaluation Test>

Evaluated was the elution into water of the additive from the cellulose acetate fiber by using the tobacco filter obtained in Example 4. For the evaluation, the manufactured tobacco filter having a length of 25 mm and not wrapped with a wrapper paper was immersed in ion exchange water so as to measure the change of content of calcium secondary phosphate over time the cellulose acetate fiber forming the tobacco filter. Incidentally, the calcium secondary phosphate content was calculated as in Example 4. FIG. 1 is a graph showing the result.

The graph of FIG. 1 clearly supports that calcium secondary phosphate contained in the cellulose acetate fiber does not elute into water. The experimental data implies that the additive is not easily liberated from the cellulose acetate fiber (does not elute into water) under the natural environment, so as to be retained in the cellulose acetate fiber for a long time. In other words, the additive produces the effect of promoting the biodegradation rate at any time and at any place under the natural environment.

<Evaluation of Biodegradability>

Evaluated was the biodegradability of the tobacco filter obtained in each of Examples 4 and 5 and Comparative Example 3. The evaluation test was conducted by burying the manufactured tobacco filter having a length of 25 mm and not wrapped with a wrapper paper in the wet soil and by measuring the weight reduction rate of the buried tobacco filter 47 days later. The weight reduction rate was calculated on the basis of the tobacco filter weight before the tobacco filter was buried in the soil and the tobacco filter weight after the tobacco filter was buried in the soil.

Table 6 shows the results.

TABLE 6

(Results of Evaluation of Biodegradability of Tobacco Filter)

| Sample | Weight reduction rate (%) | Observation of filter outer appearance |
|---|---|---|
| Example 4 | 42.1 | thinned to cause fibers to be scattered |
| Example 5 | 27.0 | thinned to cause fibers to be scattered |
| Comparative Example 3 | 2.3 | no appreciable change |

Table 6 supports that the biodegradation rate of the tobacco filter was promoted in any of the Examples of the present invention. It is also seen that the biodegradation rate of the tobacco filter is dependent on the particle diameter of the additive. To be more specific, the biodegradation rate can be increased by making smaller the particle diameter of the additive.

EXAMPLE 6

Cellulose acetate (DS: 2.5) was dissolved in acetone in a concentration of 28% by weight, followed by adding titanium oxide particles for a highly light-activated catalyst having a weight average particle diameter of 0.2 $\mu$m to the resultant solution in an amount of 1% by weight based on the amount of cellulose acetate while stirring the system so as to obtain a uniform dispersion. Then, calcium secondary phosphate particles having a weight average particle diameter of 1.20 $\mu$m were added to the resultant dispersion in an amount of 1% by weight based on the amount of cellulose acetate while stirring the dispersion until the added calcium secondary phosphate particles were dispersed uniformly so as to obtain a spinning stock solution. A cellulose acetate fiber tow and a tobacco filter were prepared as in Example 4 by using the spinning stock solution thus obtained.

The cellulose acetate fiber tow and the tobacco filter thus obtained were observed. It has been found that the moldability of the cellulose acetate fiber tow and the tobacco filter was not affected by the addition of the titanium oxide particles for the highly light-activated catalyst.

Comparative Example 5

Cellulose acetate (DS: 2.5) was dissolved in acetone in a concentration of 28% by weight, followed by adding titanium oxide particles for a highly light-activated catalyst having a weight average particle diameter of 0.02 $\mu$m to the resultant solution in an amount of 1% by weight based on the amount of cellulose acetate while stirring the system so as to obtain a uniform dispersion, thereby obtaining a spinning stock solution. A cellulose acetate fiber tow and a tobacco filter were prepared as in Example 4 by using the spinning stock solution thus obtained.

<Evaluation of Overall Degradability>

Evaluated was the overall degradability under the natural environment of the tobacco filter obtained in each of Examples 5, 6 and Comparative Examples 3 and 5. The evaluation covered a plurality of factors such as the biodegradability, the photolytic degradability, and the disintegration of the shape. Specifically, the manufactured tobacco filter having a length of 25 mm and not wrapped with a wrapper paper was put on outdoor soil so as to measure the change in the outer appearance and the volume reduction rate of the tobacco filter 6 months later. The volume reduction rate was calculated on the basis of the tobacco filter volume before. Table 7 shows the results of the outer appearance and the volume reduction rate.

TABLE 7

(Results of Evaluation of Tobacco Filter Degradability)

| Sample | Volume reduction rate (%) | Observation of sample outer appearance |
|---|---|---|
| Example 5 | 22.8 | degradation proceeded mainly from the surface in contact with soil |
| Example 6 | 39.9 | markedly thinned and overall degradation proceeded |
| Comparative Example 3 | 11.1 | No appreciable change |
| Comparative Example 3 | 20.8 | fibers in mainly filter upper surface portion were scattered |

As is apparent from Table 7, the degradation rate of the tobacco filter was promoted in any of the Examples of the present invention. It is also seen that the degradation rate of the tobacco filter is drastically promoted by the use of the additive of the present invention together with titanium oxide for the highly light-activated catalyst.

As described above, the present invention provides a cellulose acetate structure excellent in biodegradability and capable of suppressing the deterioration of quality, particularly, the generation of acetic acid odor, and a tobacco filter using the particular cellulose acetate structure of the present invention.

The technical scope of the present invention is not limited to the several embodiments described herein. Various modifications and alterations are available without departing from the spirit and scope of the general inventive concept defined in the accompanying claims.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cellulose acetate structure, at least a surface region of which comprises a biodegradable cellulose acetate composition comprising a biodegradation promoting agent contained in cellulose acetate and comprising at least one compound selected from the group consisting of an cellulose phosphate and starch phosphate.

2. The cellulose acetate structure according to claim 1, wherein said cellulose acetate has a DS value falling within a range of between 2.0 and 2.6.

3. The cellulose acetate structure according to claim 1, wherein said biodegradation promoting agent is contained in an amount of 0.01 to 10% by weight based on said cellulose acetate.

4. The cellulose acetate structure according to claim 1, wherein said biodegradation promoting agent is in the form of fine particles, and said biodegradable cellulose acetate composition further contains a dispersant for dispersing said fine particles in said composition.

5. The cellulose acetate structure according to claim 1, further comprising a photodegradation promoting agent.

6. The cellulose acetate structure according to claim 5, wherein said photodegradation promoting agent comprises titanium oxide.

7. The cellulose acetate structure according to claim 1, wherein said cellulose acetate structure is in the form of fibers.

8. The cellulose acetate structure according to claim 1, wherein said cellulose acetate structure is in the form of an unwoven fabric formed of short fibers having a length of 1 to 100 mm.

9. A tobacco filter comprising the cellulose acetate structure defined in claim 7.

10. A tobacco filter comprising the cellulose acetate structure defined in claim 8.

* * * * *